US010057702B2

(12) United States Patent
Geiger et al.

(10) Patent No.: US 10,057,702 B2
(45) Date of Patent: Aug. 21, 2018

(54) AUDIO SIGNAL PROCESSING APPARATUS AND METHOD FOR MODIFYING A STEREO IMAGE OF A STEREO SIGNAL

(71) Applicant: Huawei Technologies Co., Ltd., Shenzhen (CN)

(72) Inventors: Juergen Geiger, Munich (DE); Peter Grosche, Munich (DE)

(73) Assignee: Huawei Technologies Co., Ltd., Shenzhen (CN)

( * ) Notice: Subject to any disclaimer, the term of this patent is extended or adjusted under 35 U.S.C. 154(b) by 0 days.

(21) Appl. No.: 15/616,654

(22) Filed: Jun. 7, 2017

(65) Prior Publication Data

US 2017/0272881 A1 Sep. 21, 2017

Related U.S. Application Data

(63) Continuation of application No. PCT/EP2015/058879, filed on Apr. 24, 2015.

(51) Int. Cl.
*H04S 1/00* (2006.01)

(52) U.S. Cl.
CPC ..... *H04S 1/002* (2013.01)

(58) Field of Classification Search
CPC ..... H04S 1/002
See application file for complete search history.

(56) References Cited

U.S. PATENT DOCUMENTS 6,507,657 B1 1/2003 Kamada et al.
6,928,168 B2 8/2005 Kirkeby
7,257,231 B1 8/2007 Avendano et al.
7,315,624 B2 1/2008 Avendano et al.
7,970,144 B1 6/2011 Avendano et al.
8,019,093 B2 9/2011 Avendano et al.
(Continued)

FOREIGN PATENT DOCUMENTS

EP 0677235 B1 8/1999
EP 1814360 A2 8/2007
(Continued)

OTHER PUBLICATIONS

Wang et al., "Computational Auditory Scene Analysis: Principles, Algorithms and Applications," J. Acoust. Soc. Am. 124(1), Book Review, pp. 13-14, Acoustical Society of America, (2008).
(Continued)

*Primary Examiner* — Sonia Gay
(74) *Attorney, Agent, or Firm* — Leydig, Voit & Mayer, Ltd.

(57) ABSTRACT

The disclosure relates to an audio signal processing apparatus for modifying a stereo image of a stereo signal. The apparatus includes a panning index modifier configured to apply a mapping function to at least all panning indexes of stereo signal time-frequency segments that are within a frequency bandwidth, a first panning gain determiner configured to determine modified panning gains for time-frequency signal segments of the first and second audio signal based on the modified panning indexes, and a re-panner configured to re-pan the stereo signal according to ratios between the modified panning gains and panning gains of the first and second audio signal that correspond to the modified panning gains in time and frequency.

19 Claims, 8 Drawing Sheets

Unprocessed Stereo

Internal Widening

(56) References Cited

U.S. PATENT DOCUMENTS

| | | | | |
|---|---|---|---|---|
| 2002/0097880 | A1 | 7/2002 | Kirkeby | |
| 2004/0212320 | A1 | 10/2004 | Dowling et al. | |
| 2006/0115090 | A1* | 6/2006 | Kirkeby | H04R 5/04 381/17 |
| 2007/0041592 | A1 | 2/2007 | Avendano et al. | |
| 2007/0189551 | A1 | 8/2007 | Kimijima | |
| 2008/0304429 | A1* | 12/2008 | Bevin | H04M 3/56 370/267 |
| 2011/0132175 | A1 | 6/2011 | Sato et al. | |
| 2013/0170649 | A1 | 7/2013 | Lee | |

FOREIGN PATENT DOCUMENTS

| | | | |
|---|---|---|---|
| JP | 2009188971 | A | 8/2009 |
| KR | 100919160 | B1 | 9/2009 |
| KR | 101355414 | B1 | 1/2014 |
| WO | 9416538 | A1 | 7/1994 |

OTHER PUBLICATIONS

Vinyes et al., "Demixing Commercial Music Productions via Human-Assisted Time-Frequency Masking," Audio Engineering Society, pp. 1-9, 120th Convention, Paris, France (May 20-23, 2006).

Avendano et al., "Frequency Domain Techniques for Stereo to Multichannel Upmix," AES '22: International Conference on Virtual, Synthetic, and Entertainment Audio, pp. 1-10, Audio Engineering Society (2002).

Avendano, "Frequency-Domain Source Identification and Manipulation in Stereo Mixes for Enhancement, Suppression and Re-Panning Applications," 2003 IEEE Workshop on Applications of Signal Processing to Audio and Acoustics, pp. 55-58, Institute of Electrical and Electronics Engineers, New York, New York (2003).

Avendano et al., "A Frequency-Domain Approach to Multichannel Upmix," Journal of the Audio Engineering Society vol. 52, No. 7/8, pp. 740-749, Audio Engineering Society, (2004).

* cited by examiner

Unprocessed Stereo

Internal Widening

External Widening

AUDIO SIGNAL PROCESSING APPARATUS AND METHOD FOR MODIFYING A STEREO IMAGE OF A STEREO SIGNAL

CROSS-REFERENCE TO RELATED APPLICATIONS

This application is a continuation of International Application No. PCT/EP2015/058879, filed on Apr. 24, 2015, the disclosure of which is hereby incorporated by reference in its entirety.

TECHNICAL FIELD

The disclosure relates to the field of audio signal processing, in particular modifying the stereo image of a stereo signal, including the width of said stereo image.

BACKGROUND

Several different solutions are known which can modify (in particular, increase) the perceived spatial width/stereo image of a stereo signal.

One family of approaches for stereo widening relies on a simple linear processing that can be done in the time domain. In particular, the stereo signal pair can be transformed to a mid (sum of both channels) and side (difference) signal. Then, the ratio of side to mid is increased, and the transformation is reverted to obtain a stereo pair. The effect is to increase the stereo width. These methods belong can mainly be classified as an "internal" stereo modification approach, although the stereo width can theoretically also be extended beyond the loudspeaker span. The computational complexity is very low, but there are several disadvantages of such methods. The sources are not only redistributed among the stereo stage, but also weighted, spectrally, differently. That is, the spectral content of the stereo signal is modified via the widening process. This can degrade the audio quality. For example, the level of reverberation (which is included in the side signal) can be increased, or the level of center-panned sources (such as voices) can be decreased. Examples of such approaches are found in EP 06 772 35B1 and U.S. Pat. No. 6,507,657B1.

Another approach for stereo widening is cross-talk cancellation (CTC), which can be classified as an "external" stereo modification. The goal of CTC is to increase the stereo width beyond the loudspeaker span angle or, in other words, virtually increase the loudspeaker span angle. To this end, such methods filter the stereo signals to attempt to cancel the path from the left loudspeaker to the right ear, and vice versa. However, such an approach cannot overcome limitations in the signals, e.g. when the signal does not use the full stereo stage. Further, CTC introduces coloring artifacts (i.e., spectral distortion) which deteriorate the listening experience. In addition, CTC works only for a relatively-small sweet spot, meaning that the desired effect can only be perceived in a small listening area. One example of CTC is given in U.S. Pat. No. 6,928,168B2.

SUMMARY

It is an object of the disclosure to modify a stereo image of a stereo signal that includes a first and second audio signal.

Embodiments of the disclosure are provided by the features of the independent claims. Further implementation forms are apparent from the dependent claims, the description and the figures.

According to a first aspect, the disclosure relates to an audio signal processing apparatus modifying a stereo image of a stereo signal that includes a first and second audio signal. The audio signal processing apparatus includes a panning index modifier configured to apply a mapping function to at least all panning indexes of stereo signal time-frequency segments that are within a frequency bandwidth, thereby providing modified panning indexes. The at least all panning indexes characterize panning locations for the stereo signal time-frequency segments.

The apparatus further includes a first panning gain determiner configured to determine modified panning gains for time-frequency signal segments of the first and second audio signal based on the modified panning indexes and a re-panner configured to re-pan the stereo signal according to ratios between the modified panning gains and panning gains of the first and second audio signal that correspond to the modified panning gains in time and frequency, thereby providing a re-panned stereo signal. As used herein, panning gains correspond to each other when, for example, they both include values for the same time-frequency bin or segment.

Thus, a stereo image of a stereo signal is modified by re-distributing the spectral energy of the stereo signal. With this technique, the re-panned stereo signal, which may have widened or narrowed stereo image vis-à-vis the unmodified stereo signal, does not include unwanted artifacts or spectral distortion.

In a first implementation form of the audio signal processing apparatus according to the first aspect, the panning index modifier is configured to apply a non-linear mapping function to the at least all panning indexes.

In a second implementation form of the audio signal processing apparatus according to the first aspect, the mapping function is based on a sigmoid function.

Non-linear mapping functions (including sigmoid mapping functions) may include curves that are perceptually motivated such as a decrease in human localization resolution for sources that are panned more towards the sides rather than the center of the stereo image. Said functions may also avoid clustering of sources within a stereo image.

In a third implementation form of the audio signal processing apparatus according to the first aspect or any preceding implementation form of the first aspect, the mapping function is expressed as or based on:

$$\Psi'(m,k) = \mathrm{sign}(\Psi(m,k))\frac{\frac{1}{1+e^{-|\Psi(m,k)|a}} - 0.5}{\frac{1}{1+e^{-a}} - 0.5},$$

wherein $\Psi(m,k)$ denotes a panning index, $\Psi'(m,k)$ denotes a modified panning index, and a controls a mapping function curvature.

In a fourth implementation form of the audio signal processing apparatus according to the first aspect or any preceding implementation form of the first aspect, the panning index modifier is configured to apply a polynomial mapping function to the at least all panning indexes. Polynomial mapping functions may reduce complexity vis-à-vis complex analytic functions (e.g., replacing divisions and exponential functions with additions and multiplications).

In a fifth implementation form of the audio signal processing apparatus according to the first aspect or any preceding implementation form of the first aspect, the re-panner is configured to re-pan the stereo signal according to the following equations:

$$X_1'(m,k) = \frac{g_L'(m,k)}{g_L(m,k)} X_1(m,k),$$

$$X_2'(m,k) = \frac{g_R'(m,k)}{g_R(m,k)} X_2(m,k),$$

wherein:

$X_1(m,k)$ denotes a time-frequency signal segment of the first audio signal, $X_2(m,k)$ denotes a time-frequency signal segment of the second audio signal, $X_1'(m,k)$ denotes a time-frequency signal segment of a re-panned first audio signal of the re-panned stereo signal, $X_2'(m,k)$ denotes a time-frequency signal segment of a re-panned second audio signal of the re-panned stereo signal, $g_L(m,k)$ denotes a time-frequency signal segment panning gain for the first audio signal, $g_R(m,k)$ denotes a time-frequency signal segment panning gain for the second audio signal, $g'_L(m,k)$ denotes a time-frequency signal segment modified panning gain for the first audio signal, and $g'_R(m,k)$ denotes a time-frequency signal segment modified panning gain for the second audio signal.

In a sixth implementation form of the audio signal processing apparatus according to the first aspect or any preceding implementation form of the first aspect, the first panning gain determiner is configured to determine the modified panning gains based on the following equations:

$$g_L'(m,k) = \cos\left(\frac{\pi}{2}\Psi'(m,k)\right),$$

$$g_R'(m,k) = \sin\left(\frac{\pi}{2}\Psi'(m,k)\right).$$

In a seventh implementation form of the audio signal processing apparatus according to the first aspect or any preceding implementation form of the first aspect, the panning index modifier is configured to apply the mapping function to all panning indexes of stereo signal time-frequency segments having values for audio signals that are approximately at least 1500 Hz. This reduces computational complexity by limiting the processed frequency range in a perceptually-motivated way. Thus, frequencies below this threshold can remain unchanged without losing much of the perceived widening or narrowing effect on the stereo image.

In an eighth implementation form of the audio signal processing apparatus according to the first aspect or any of the first to sixth implementation forms of the first aspect, the panning index modifier is configured to apply the mapping function to all panning indexes of the stereo signal time-frequency segments.

In a ninth implementation form of the audio signal processing apparatus according to the first aspect or any preceding implementation form of the first aspect, the index modifier is further configured to receive a parameter for selecting a curve of the mapping function. This allows a user to select at least one of a type of stereo image modification (e.g., linear or non-linear mapping functions) and the degree that the stereo image modification is applied (e.g., curvature of the mapping function curve).

In a tenth implementation form of the audio signal processing apparatus according to the first aspect or any preceding implementation form of the first aspect, the audio signal processing apparatus further includes at least one of a pan index determiner configured to determine the at least all panning indexes based on comparing time-frequency signal segment values of the first and second audio signals that correspond in time and frequency and a second panning gain determiner configured to determine panning gains for time-frequency signal segments of the first and second audio signal based on the at least all panning indexes.

In an eleventh implementation form of the audio signal processing apparatus according to the preceding implementation form, at least one the first and second panning gain determiners utilize a polynomial function. This results in reduced computational complexity due to replacing a sine and cosine function by approximating said functions with a polynomial function.

In a twelfth implementation form of the audio signal processing apparatus according to the first aspect or any preceding implementation form of the first aspect, the apparatus further includes at least one of one or more time-to-frequency units configured to transform the stereo signal from the time domain to the frequency domain and one or more frequency-to-time units configured to transform the re-panned stereo signal from the frequency domain to the time domain.

In a thirteenth implementation form of the audio signal processing apparatus according to the first aspect or any preceding implementation form of the first aspect, the apparatus further includes a cross-talk canceller configured to cancel cross-talk between a first and a second audio signal of the re-panned stereo signal. The re-panned stereo signal takes-up more of a potential maximum stereo image that can be reproduced over a stereo system, and thus makes for a more effective stereo signal for cross-talk cancellation in creating a stereo image perceived to extend beyond the loudspeakers of a stereo system.

According to a second aspect, the disclosure relates to an audio signal processing method for modifying a stereo image of a stereo signal that includes a first and second audio signal, the method includes obtaining panning indexes and panning gains, the obtained panning indexes characterizing panning locations for stereo signal time-frequency segments and the obtained panning gains characterizing panning locations for time-frequency signal segments of the first and second audio signals, applying a mapping function to at least all of the obtained panning indexes of the stereo signal time-frequency segments that are within a frequency bandwidth, thereby providing modified panning indexes, determining modified panning gains for the time-frequency signal segments of the first and second audio signal based on the modified panning indexes, and repanning the stereo signal according to ratios between the modified panning gains and the obtained panning gains that correspond to the modified panning gains in time and frequency.

The audio signal processing method can be performed by the audio signal processing apparatus. Further features of the audio signal processing method may perform any of the implementation form functionalities of the audio signal processing apparatus.

According to a third aspect, the disclosure relates to a computer program comprising a program code for performing the method when executed on a computer.

The audio signal processing apparatus can be programmably arranged to perform the computer program.

The disclosure can be implemented in hardware and/or software.

BRIEF DESCRIPTION OF EMBODIMENTS

Embodiments of the disclosure will be described with respect to the following figures, in which.

DETAILED DESCRIPTION OF EMBODIMENTS

Figure 1A:
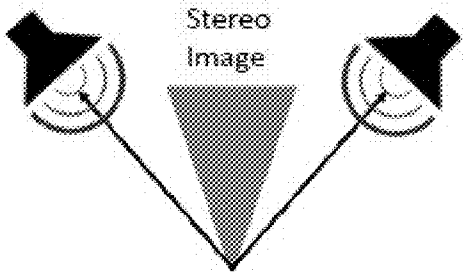
FIGS. 1A to 1C are diagrams of various stereo image widths.
Figure 1B:
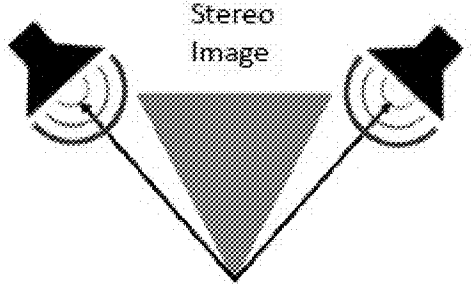
Figure 1C:
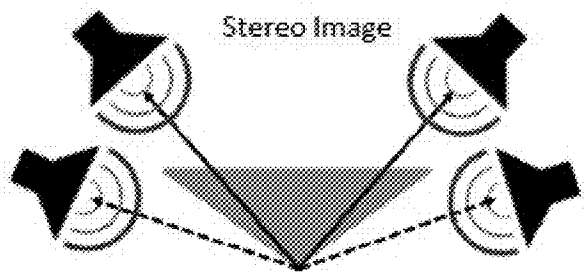

FIGS. 1A to 1C are diagrams of various stereo image widths. In particular, FIG. 1A shows an example of a stereo image width produced by an unprocessed stereo signal which is narrower than the widest possible stereo image. FIGS. 1B and 1C respectively show internal and external widening of a stereo image.

Stereo recordings of media (e.g. music or movies) contain different audio sources which are distributed within a virtual stereo sound stage or stereo image. Sound sources can be placed within the stereo image width, which is defined and limited by the distance between a stereo pair of loudspeakers. For example, amplitude panning can be used to place sound sources at any space on within the stereo image. Sometimes, the widest possible stereo image is not used in stereo recordings. In such cases, it is desirable to modify the spatial distribution of the sources in order to take advantage of the widest possible stereo image that a stereo system can produce. This enhances the perceived stereo effect and results in a more immersive listening experience.

Other application scenarios may exist where it is desirable to narrow the stereo image, such as when a stereo pair of speakers are placed far apart from each other.

Internal widening of the stereo image is shown by FIG. 1B vis-a-vis the stereo image of FIG. 1A. External widening, which may utilize cross-talk cancellation (CTC), is shown by FIG. 1C. External widening attempts to extend the perceived stereo image beyond the loudspeaker span. Embodiments may include apparatus and methods for internal and external stereo modification that are complementary, and thus can be combined to achieve a better effect and further improve the listening experience.

Embodiments may further include apparatuses and methods for internally modifying a stereo image (e.g., narrowing and widening). From a stereo signal, a time- and frequency-independent measure (e.g., a panning index) can be extracted which characterizes the location of audio sources within the stereo image.

One skilled in the art is aware of panning indexes and how to calculate said indexes. The present disclosure departs from prior art techniques by, inter alia, applying a mapping function to at least all panning indexes (e.g., mapping said indexes) of stereo signal time-frequency segments within a frequency bandwidth. That is, time-frequency segments that include spectral content within a frequency bandwidth (e.g., 1.5 to 22 kHz) may be modified to internally modify the stereo signal. The frequency bandwidth may be larger, the same, or smaller than the stereo signal bandwidth.

For example, a mapping function may be applied to the panning indexes of all time-frequency bins in order to widen the stereo image to span the full distance between speakers. Different mapping functions are described in more detail in describing FIGS. 3 to 5.

One advantage of the present disclosure is that modifying the panning index may be independent of time and frequency, and thus independent of the stereo signal content. The overall spectral distribution of the stereo signal is unchanged, since parts of the signal are only redistributed in the modified stereo image. The result is that no coloration artifacts (spectral distortions) are introduced. The panning index modification results, in the case of stereo image widening, in a wider stereo image, where sound sources are moved more towards the sides/speaker boundaries and away from the center of the stereo image.

Further, embodiments may reduce the computational complexity of stereo image modification vis-à-vis conventional techniques, without perceptually influencing (e.g., adding distortion) to the modified stereo signal. To this end, the mapping function, which modifies the panning indexes, can be approximated via a polynomial function. Then, instead of evaluating an analytic expression of a mapping curve, the polynomial function is evaluated. Since the computational complexity of evaluating the polynomial function is less than for the analytic expression of the mapping curve, this leads to an overall reduced complexity of the system.

Similarly, the mapping curve may be implemented as a look up table (LUT), which maps panning indexes according to the analytic expression or polynomial function.

Embodiments include extracting panning indexes from a stereo signal. An approach for extracting the panning index is described in U.S. Pat. No. 7,257,231B1. After a time-frequency transformation, such as a fast Fourier transformation (FFT), the panning index may be calculated for each time-frequency segment of the stereo signal. A time-frequency signal segment corresponds to a representation of a signal in a given time and frequency interval. For example, a time-frequency signal segment may correspond to a (complex) frequency sample generated for a given time segment. Thus, each time-frequency signal segment may be a FFT bin value generated by applying an FFT to the corresponding segment.

The panning index is derived from the relation between the left and the right channel (or first and second channels) of a stereo signal. While the human hearing mechanism uses time and level differences between the signals at the two ears for source localization, panning index may be based only on level differences. For each time-frequency signal segment, the panning index characterizes the corresponding angle on the stereo stage (i.e., where in the stereo image the time-frequency signal segment "appears").

Figure 2:
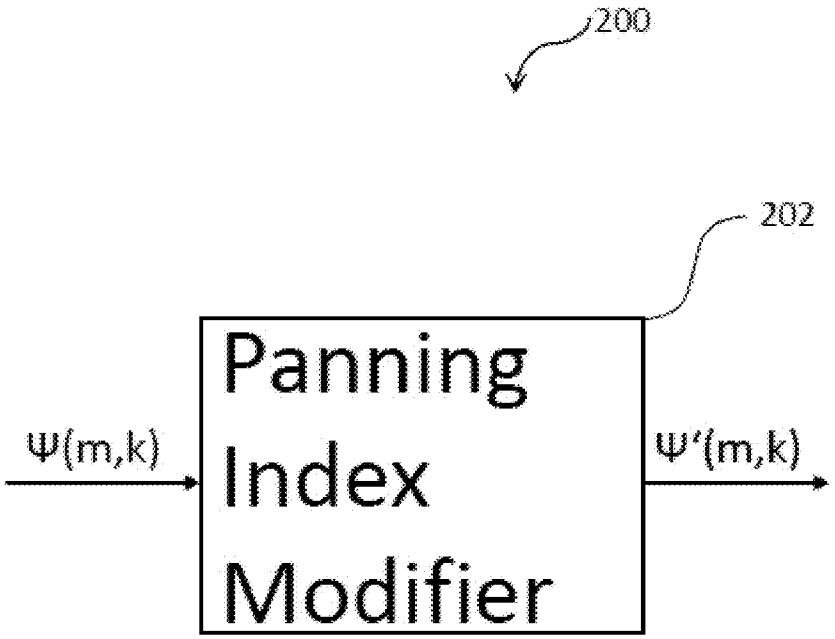
FIG. 2 shows a diagram of an audio signal processing apparatus for modifying a panning index of a time-frequency signal segment of a stereo signal according to an embodiment.

FIG. 2 shows a diagram of an audio signal processing apparatus 200 for modifying a stereo image of a stereo signal according to an embodiment. Apparatus 200 includes panning index modifier 202. Panning index modifier 202 is configured to apply a mapping function to at least all panning indexes $\Psi(m,k)$ of stereo signal time-frequency segments within a frequency bandwidth, thereby providing modified panning indexes.

For example, an input panning index $\Psi(m,k)$ can be modified independent of time and frequency, thus obtaining a modified panning index $\Psi'(m,k)$.

Modifications include narrowing and widening the stereo image. For example, a part of the "used" stereo image (e.g., the amount of perceived width able to be produced over a stereo system in comparison to the panning-spectral distribution of the audio signal) may be widened, since the stereo image itself is limited by the loudspeaker span. As consequence, different stereo systems may utilize different modification curves due to, for example, the distance between stereo loudspeakers.

That is, one achievement aspect of modifying the panning indexes is moving differently-panned audio sources more to the side and thus "stretching" the distribution on the stereo image.

Widening or optimizing the used width of the sound image is useful for several applications. Some signals may not use the full available stereo image, and widening the distribution can lead to a more immersive listening experience without introducing unwanted artifacts into the widened stereo signal.

Another application is further processing a widened signal with a Crosstalk cancellation (CTC) or similar technique, which typically rely on psycho-acoustic models to widen the perceived stereo image beyond the distance of the loudspeakers. This goal is, however, not achieved completely. In this case, internal widening of the input signal can overcome the practical limitations of CTC and contribute to a wider stereo image where the spatial distribution of the sources is accurately maintained.

Furthermore, certain listening setups may require a modification of the stereo image. For example, in a conventional stereo playback setup the loudspeaker span may be too wide (compared to the optimal stereo listening conditions) and it may be beneficial to narrow the used stereo stage in the signal to compensate for the suboptimal loudspeaker setup.

Thus, embodiments may include obtaining distance information between the loudspeakers and between a listening spot and each of the two loudspeakers.

For widening a stereo image, the panning index modifier 202 is required to increase the absolute value of a panning index (independent of time and frequency), in order to move sources more to the sides of the stereo image. Ideally, no perceived "holes" should be created within the sound image (e.g., where no sources are present). Also, no spots should be created on the stereo image where several sources are clustered together.

Spoken in mathematical terms, these two requirements are fulfilled by, for example, a bijective mapping function. Another criterion may be to have a steady, monotonically increasing function. Another requirement for the mapping curve/function may be that all sources that are panned to the center should remain in the center.

In addition, a mapping curve could exploit psychoacoustic findings about the human hearing capabilities. For example, the angular resolution for human localization differentiation is higher in the center (about 1 degree) of a stereo image compared to the sides (about 15 degrees).

A mapping curve or mapping function may then be required that modifies the panning index independently of time and frequency and ideally fulfils some or all of the above-described properties.

Figure 3:
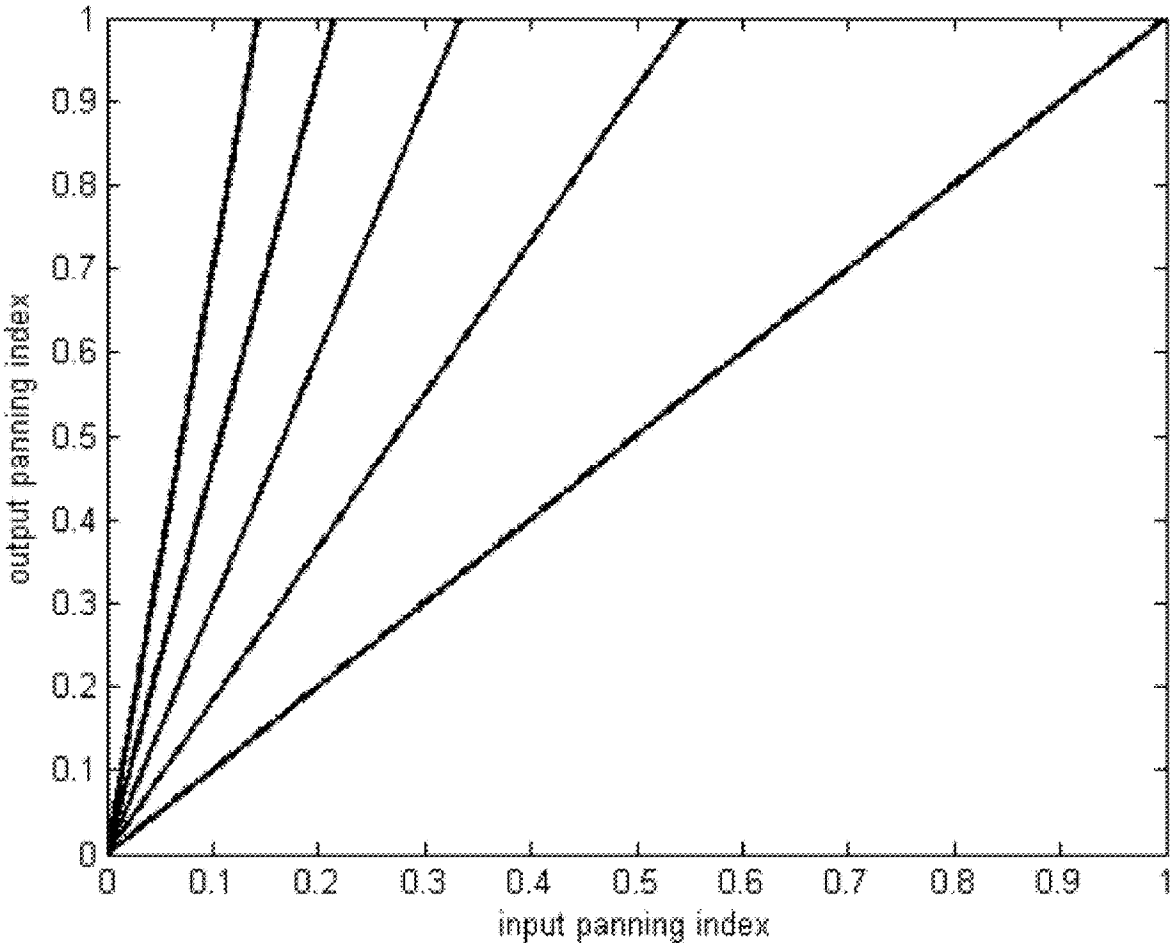
FIGS. 3 to 5 are graphs showing possible implementation forms of a mapping curve for widening a stereo image.
Figure 4:
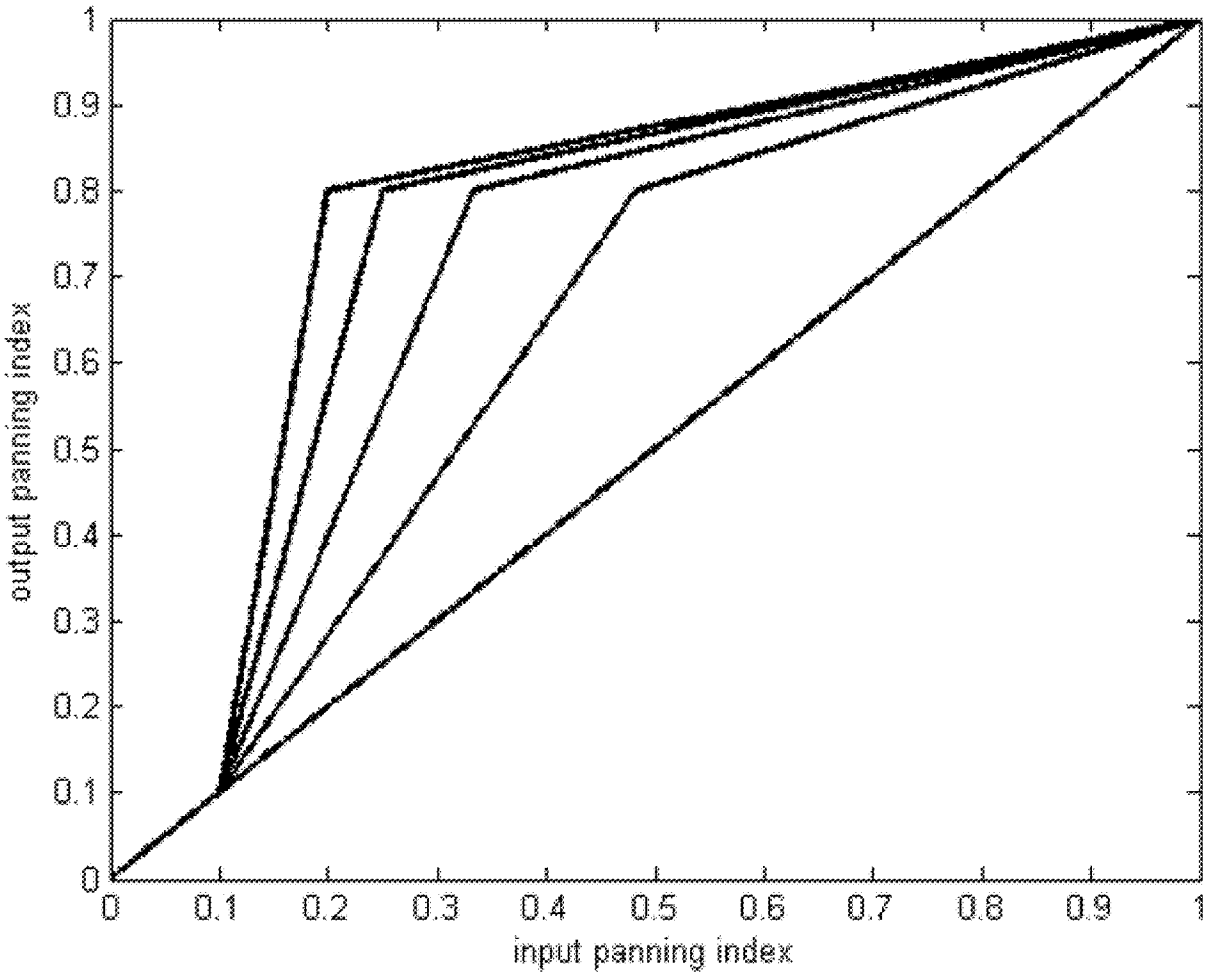
Figure 5:
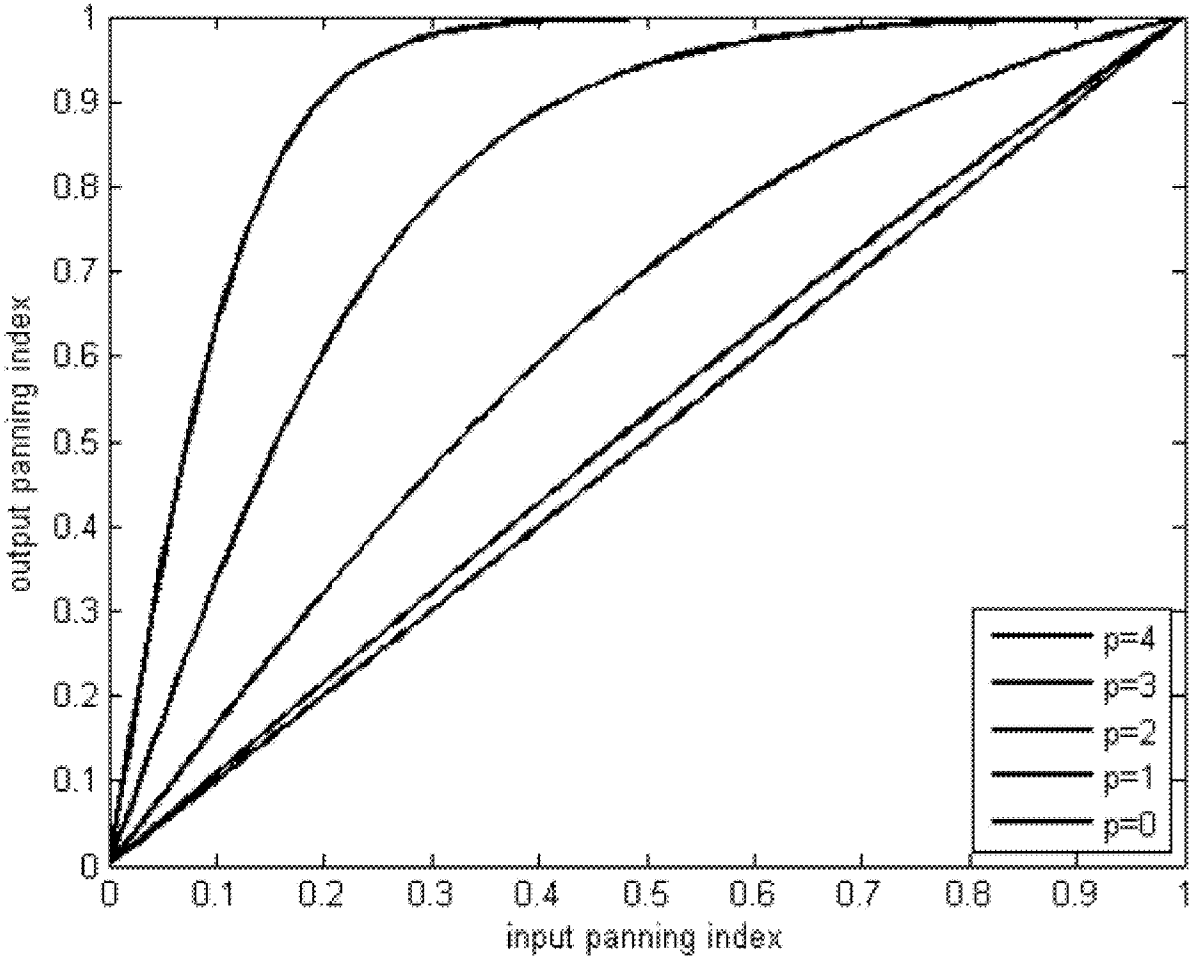

FIGS. 3 to 5 are graphs showing possible implementation forms of a mapping curve for widening a stereo image. Since the panning index is symmetric, only the range between 0 and 1 may be described, but the range between −1 and 0 can be processed accordingly via a symmetrical curve or function. Of course, panning indexes may use other value ranges besides −1 to 1

One possible implementation form for stereo widening is to multiply the panning index by a constant factor and limit it to the maximum of 1:

$$\Psi'(m,k)=\min(1,p\times\Psi(m,k)) \tag{1}$$

where p is the factor that controls the slope of the increase in width. Several curves obtained with different repanning factors p are illustrated in FIG. 3. Panning index modifier 202 could modify input panning indexes according to or based on (e.g., derived or approximated) one or more curves shown in FIG. 3.

An advantage of this implementation form is that the repanning curve(s) is/are simple. The curves of FIG. 3, however, do not represent a bijective function. All sources that have a panning index larger than the bend in the curve are mapped to the maximum panning index of 1.

One possible implementation form of a mapping curve for widening a stereo image is graphically shown by FIG. 4. Panning index modifier 202 could modify input panning indexes according to or based on (e.g., derived or approximated) one or more curves shown in FIG. 4.

The curves shown in FIG. 4 are piecewise linear and controlled by a low bend point bL and a high bend point bH, which are 0.1 and 0.8 in FIG. 4, respectively, and also by a gradient p. Panning indexes smaller than bL are not modified. The gradient p is applied to panning indexes larger than bL, up to an output panning index of bH, above which the gradient is determined in a way that the function reaches the point (1,1). Such a curve family fulfills the requirement that sources panned to the center (or close to the center) are not modified, and that the curve should be bijective. However, since the curve is piecewise linear and thus has bends, it may cause unnatural clusters in the modified panning index distribution.

Another implementation form can overcome the above-noted limitations, which is based on (e.g., derived or approximated) or expressed as a sigmoid function. The curves displayed in FIG. 5 are steady and without bends, and represent bijective functions. Panning index modifier 202 could modify input panning indexes according to or based on one or more curves shown in FIG. 5.

The analytic expression of the curve can be derived as follows. The curves are based on a sigmoid function $$\Psi'(m,k)=\frac{1}{1+e^{-\Psi(m,k)a}}, \tag{2}$$

which represents the preliminary form of the curve. The parameter $a=2^p-1$ controls the curve and an increase in p increases the widening effect of the curve. In order to fit the curve to the points (0,0) and (1,1), an affine transform is applied, resulting in a final version of the curve, $$\Psi'(m,k)=\frac{\frac{1}{1+e^{-\Psi(m,k)a}}-0.5}{\frac{1}{1+e^{-a}}-0.5}, \tag{3}$$

which is still controlled by the parameter a that is derived from p. This curve expression now fulfils the previously-described requirements. For example, the angular resolution localization observed in humans (e.g., just noticeable angular differences) are exploited with this curve expression: smaller panning indexes (corresponding to center panned sources) on a 0 to 1 scale are marginally increased, whereas for larger panning indexes, a larger increase is required in order to result in a perceived difference.

As mentioned, all panning index modification curves are defined here only for the panning index range between 0 and 1. Application for the range between −1 and 0 is straightforward with a mirrored (in particular, mirrored at the abscissa and the ordinate of the coordinate system) version of the function. To cover the panning index range between −1 and 0 in the analytic expression, Equation (3) may be modified as $$\Psi'(m,k) = \mathrm{sign}(\Psi(m,k))\frac{\frac{1}{1+e^{-|\Psi(m,k)|a}} - 0.5}{\frac{1}{1+e^{-a}} - 0.5}. \tag{4}$$

In addition, all curves can also be applied for stereo narrowing instead of stereo widening, by mirroring at the diagonal axis y=x. This may be obtained with the inverse function of Equation (3), which is $$\Psi'(m,k) = -\frac{1}{a}\log\left(\frac{1}{\Psi(m,k)\cdot\left(\frac{1}{1+e^{-a}-0.5}\right)+0.5} - 1\right) \tag{5}$$

for the range $\Psi(m,k)\epsilon[0,1]$.

Panning index modifier 202 could modify input panning indexes according to or based on (e.g., derived or approximated) one or more curves shown in FIGS. 3 to 5. For example, panning index modifier 202 could be configured utilizing only one curve. Panning index modifier 202 could be configured utilizing only one mapping function. Panning index modifier 202 could be configured to receive a user input, wherein a mapping function curvature is controlled (e.g., receiving a parameter related to p) and/or a mapping function selection (e.g., one of the mapping functions related to FIGS. 3 to 5) is chosen.

Panning index modifier 202 can implement a mapping function in several ways. For example, one implementation form directly utilizes Equations (3) or (4) for mapping panning indexes.

Another implementation form reduces computational complexity via a polynomial approximation of the complex analytical function in Equations (3) or (4) (i.e., a polynomial mapping function). For example, a least-squares fit of a polynomial function to the desired mapping curve(s) results in a more efficient implementation. The order of the polynomial can be controlled. The polynomial coefficients can be computed once and stored. During runtime, the polynomial is evaluated instead of the analytical expression of the curve. The divisions and exponential functions in the analytic expression of Equation (3) can be very expensive on a chip implementation, and replacing them by several additions and multiplications helps reduce the computational complexity.

Another implementation form reduces computational complexity by limiting the processed frequency range. While the panning index modification may be performed independent of frequency, certain abilities of the human hearing system can be exploited to reduce the computational complexity. Embodiments employ amplitude panning and therefore rely on interaural level differences, which are mainly used for localization of audio sources with frequencies of roughly 1500 Hz and higher. Thus, frequencies below this threshold can remain unchanged without losing much of the stereo widening effect.

Another implementation form implements the mapping function via a lookup table. In this case, the function is discretized.

Figure 6:
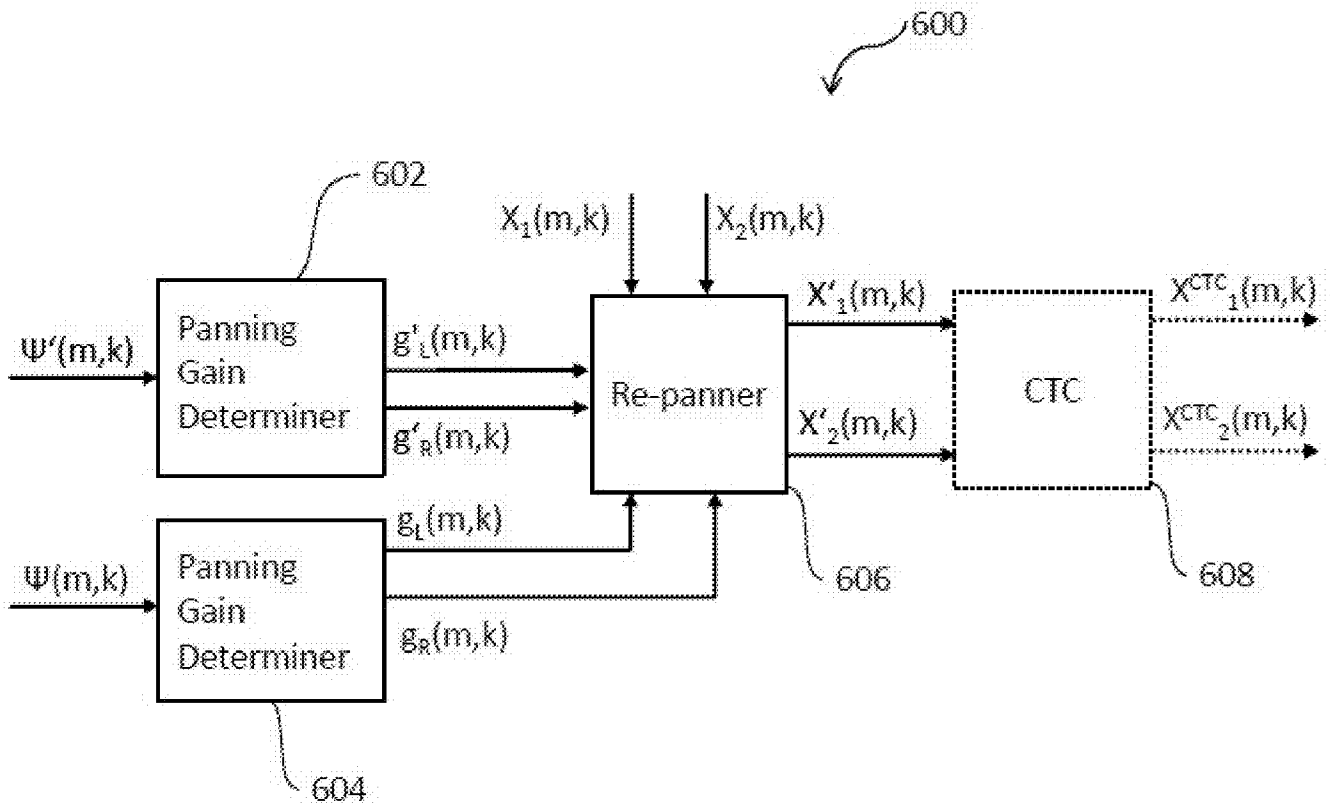
FIG. 6 shows a diagram of an audio signal processing apparatus for modifying a stereo image of a stereo signal according to an embodiment.

FIG. 6 shows a diagram of an audio signal processing apparatus 600 for modifying a stereo image of a stereo signal according to an embodiment. Panning gain determiner 602 receives a modified panning index Ψ'(m,k), which may be modified by panning index modifier 202 as explained above. Panning gain determiner 604 receives an unmodified panning index Ψ(m,k) that was extracted from, for example, a stereo signal.

Panning gain determiners 602 and 604 each produce panning gains based on the received panning index. As explained before, each panning index characterizes a certain location within a stereo image. For a given panning index (Ψ(m,k) or Ψ'(m,k)), the stereo channel gains can be determined in one implementation form by the panning gain determiners 604 and 604 utilizing the energy-preserving panning law:

$$g_L(m,k) = \cos\left(\frac{\pi}{2}\Psi(m,k)\right)$$
$$g_R(m,k) = \sin\left(\frac{\pi}{2}\Psi(m,k)\right), \tag{6}$$

where $g_L(m,k)$ and $g_R(m,k)$ denote the gain for the left (e.g., first input signal) and the right (e.g., second input signal) channel, respectively, for the time-frequency bin determined by m and k of the input stereo signal. Panning gain determiner 602 may utilize the energy-preserving panning law to calculate modified panning gains gL'(m,k) and gR'(m,k).

In one implementation form of panning gain determiners 602 and 604, a polynomial approximation may be utilized for calculating the panning gain according to Equation (6) by, for example, replacing the sine and cosine function by an approximation with a polynomial function.

At this point, the signal contained in a certain time-frequency bin (i.e., stereo signal time-frequency segments) can be moved to create a modified stereo image via re-panner 606. Re-panner 606 may receive the panning gains, the modified panning gains, and the input stereo signal that the panning gains are based on. In one implementation form of re-panner 606, re-panner 606 generates a stereo signal with a modified stereo image utilizing the expression:

$$X_1'(m,k) = \frac{g_L'(m,k)}{g_L(m,k)}X_1(m,k)$$
$$X_2'(m,k) = \frac{g_R'(m,k)}{g_R(m,k)}X_2(m,k), \tag{7}$$

where $X_1(m,k)$, $X_2(m,k)$ is the input stereo signal and $X_1'(m,k)$ and $X_2'(m,k)$ is the output stereo signal with a modified stereo image.

Apparatus 600 may further include cross-talk canceller 608 configured to cancel cross-talk between a first and a second audio signal of the re-panned stereo signal (X1'(m,k) and X2'(m,k)) and output a stereo signal (XCTC1(m,k) and XCTC2(m,k)) with a perceived stereo image that extends beyond the distance of the loudspeakers.

Figure 7:
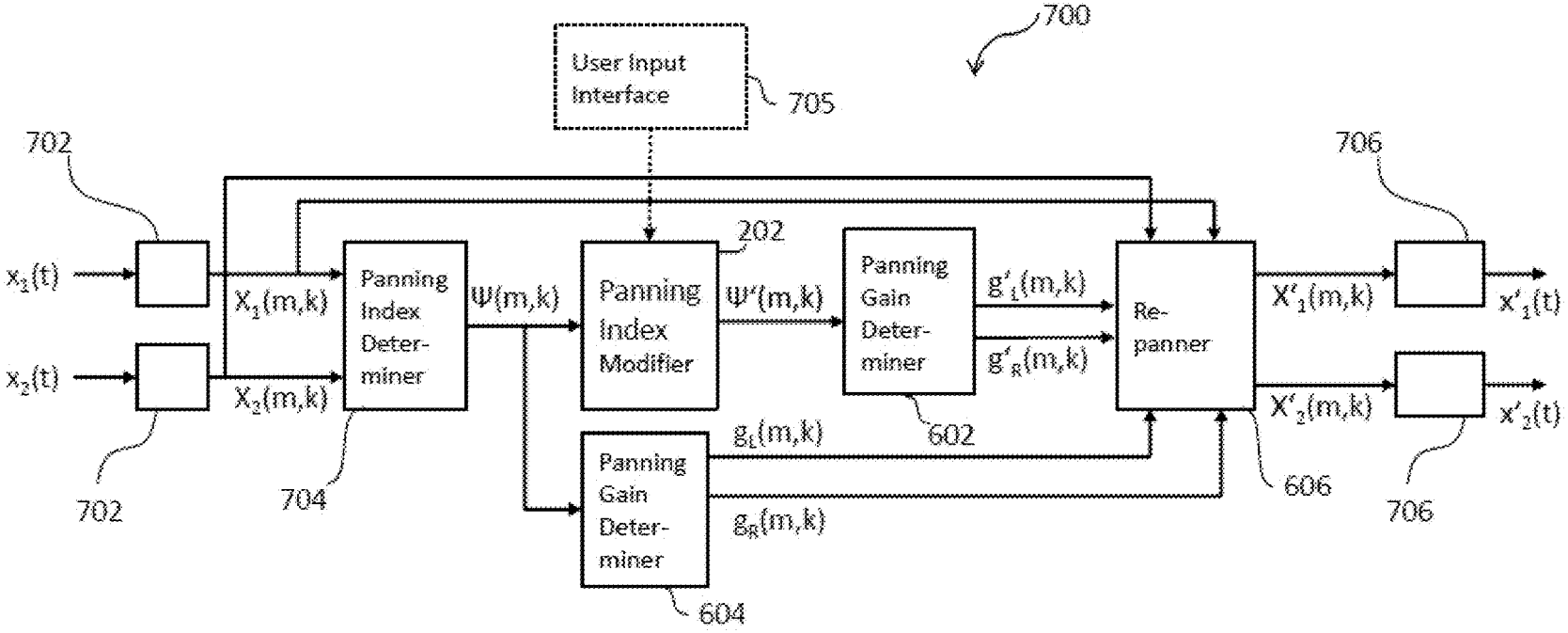
FIG. 7 shows a diagram of an audio signal processing apparatus for modifying a stereo image of a stereo signal according to an embodiment.

FIG. 7 shows a diagram of an audio signal processing apparatus 700 for modifying a stereo image of a stereo signal according to an embodiment. An input stereo signal (x1(t), x2(t)) is transformed into a frequency domain signal (X1(m,k), X2(m,k)) via time-to-frequency units 702.

After the time-frequency transformation, the panning index is extracted from the stereo pair X1(m,k), X2(m,k), using, for example, the method described in U.S. Pat. No. 7,257,231 B1, via panning index determiner 704.

This method for panning index extraction is based on the amplitude similarity between the signals X1(m,k) and X2(m,k). For example, when the similarity in a certain time-frequency bin is lower, the audio source corresponding to this time-frequency bin is panned more to one side, i.e. into the direction of one of the two input signals. In one implementation form of panning index determiner 704, a similarity index ψ(m,k) is calculated as $$\psi(m,k) = 2\frac{|X_1(m,k)X_2^*(m,k)|}{|X_1(m,k)|^2 + |X_2(m,k)|^2}, \tag{8}$$

where the terms in the denominator are the signal energy in the first (left) and second (right) signals of the stereo input signal, respectively. This similarity index is symmetric with respect to $X_1(m,k)$ and $X_2(m,k)$. Therefore, this similarity index leads to an ambiguity and, on its own, can not indicate the direction (e.g., left or right) where a signal is panned. In order to resolve the ambiguity, the energy difference $$\Delta(m,k)=|X_1(m,k)|^2-|X_2(m,k)|^2 \tag{9}$$

can be used. An indicator is derived from the energy difference, $$\hat{\Delta}(m,k) = \begin{cases} 1 \text{ if } \Delta(m,k) < 0 \\ 0 \text{ if } \Delta(m,k) = 0 \\ -1 \text{ if } \Delta(m,k) > 0 \end{cases}, \tag{10}$$

and combined with the similarity index ψ(m,k), in order to obtain the panning index $$\Psi(m,k)=[1-\psi(m,k)]\hat{\Delta}(m,k) \tag{11}$$

In this implementation form, panning index determiner 704 provides panning index that has a possible range from −1 to 1, where −1 indicates a signal completely panned to the first input signal (left), 0 corresponds to a center-panned signal, and 1 indicates a signal completely panned to the second input signal (right). The perceived angle within the stereo image is characterized by the panning index.

Panning index modifier 202 may modify a received panning index, as described above. One implementation form includes user input interface 705, which may provide a parameter to control the degree of stereo image modification (e.g., a mapping function curvature) and/or select a type of panning modification (e.g., selecting one of the panning modification techniques corresponding to the family of curves shown in FIGS. 3 to 5).

Panning gain determiners 602 and 604 may generate panning gains, as described above, which may be then fed to re-panner 606, which generates an output stereo signal with a modified stereo image (i.e., a re-panned stereo signal), as described above. The output stereo signal is transformed into the time domain by frequency-to-time units 706, thus outputting a time-domain output stereo signal x'1(t) and x'2(t).

In one implementation form of apparatus 700, time-domain signals can be transformed to the frequency domain via units 702 using a fast Fourier transform with a block size of 512 or 1024, with a 48 kHz sampling rate. The inventors find a good tradeoff in accuracy and reduction in complexity when the polynomial approximation is set to a polynomial order of 3 for the panning index mapping function utilized by panning index modifier 202 and to 2 for the panning gain calculation utilized by panning gain determiners 602 and 604. For a re-panning parameter p=4 and a polynomial degree of 3, the polynomial coefficients could be [a3 a2 a1 a0]=[4.5214 −8.4350 4.8328 0.1724]. The polynomial function may then be utilized by panning index modifier as $\Psi'=a3\cdot\Psi3+a2\cdot\Psi2+a1\cdot\Psi+a0$.

Embodiments may include all features shown in FIG. 7, but may also include just re-panner 606. For example, a bitstream may include panning gains, modified panning gains, and a frequency-domain input stereo signal, all of which may be fed into re-panner 606. In another variation, panning indexes may be included in a bitstream and thus panning index determiner 704 may not be needed.

Figure 8:
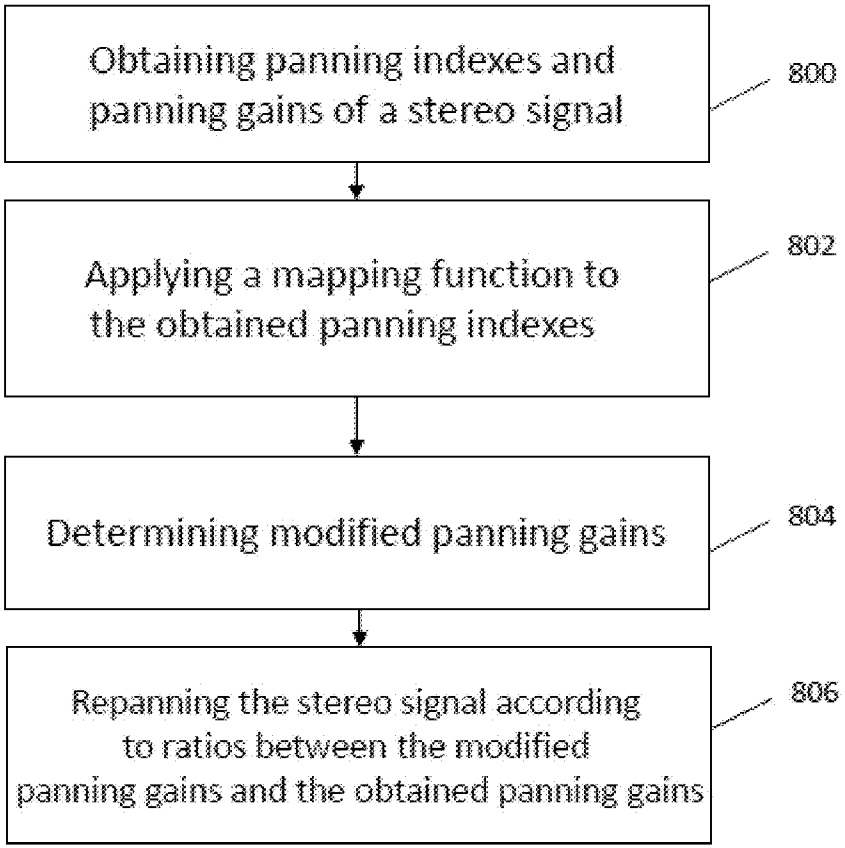
FIG. 8 shows a diagram of an audio signal processing method for modifying a stereo image of a stereo signal according to an embodiment.

FIG. 8 shows a diagram of an audio signal processing method for modifying a stereo image of a stereo signal according to an embodiment.

Step 800 includes obtaining panning indexes and panning gains, the obtained panning indexes characterizing panning locations for stereo signal time-frequency segments of an input stereo signal and the obtained panning gains characterizing panning locations for time-frequency signal segments of the first and second audio signals of the input stereo signal. Said indexes and gains may be obtained directly from a bitstream or calculated based on the input stereo signal, as described above, or a combination thereof.

Step 802 includes applying a mapping function to at least all of the obtained panning indexes of the stereo signal time-frequency segments within a frequency bandwidth. Step 804 includes determining modified panning gains for the time-frequency signal segments of the first and second audio signal based on the modified panning indexes.

Step 806 includes repanning the input stereo signal according to ratios between the modified panning gains and the obtained panning gains that correspond to the modified panning gains in time and frequency. That is, panning gains correspond to each other when, for example, they both include values for the same time-frequency bin or segment.

Embodiments of the disclosure may be implemented in a computer program for running on a computer system, at least including code portions for performing steps of a method according to the disclosure when run on a programmable apparatus, such as a computer system or enabling a programmable apparatus to perform functions of a device or system according to the disclosure.

A computer program is a list of instructions such as a particular application program and/or an operating system. The computer program may for instance include one or more of: a subroutine, a function, a procedure, an object method, an object implementation, an executable application, an applet, a servlet, a source code, an object code, a shared library/dynamic load library and/or other sequence of instructions designed for execution on a computer system.

The computer program may be stored internally on computer readable storage medium or transmitted to the computer system via a computer readable transmission medium. All or some of the computer program may be provided on transitory or non-transitory computer readable media permanently, removably or remotely coupled to an information processing system. The computer readable media may include, for example and without limitation, any number of the following: magnetic storage media including disk and tape storage media; optical storage media such as compact disk media (e.g., CD-ROM, CD-R, etc.) and digital video disk storage media; nonvolatile memory storage media including semiconductor-based memory units such as FLASH memory, EEPROM, EPROM, ROM; ferromagnetic digital memories; MRAM; volatile storage media including registers, buffers or caches, main memory, RAM, etc.; and data transmission media including computer networks, point-to-point telecommunication equipment, and carrier wave transmission media, just to name a few.

A computer process typically includes an executing or running program or portion of a program, current program values and state information, and the resources used by the operating system to manage the execution of the process. An operating system (OS) is the software that manages the sharing of the resources of a computer and provides programmers with an interface used to access those resources. An operating system processes system data and user input, and responds by allocating and managing tasks and internal system resources as a service to users and programs of the system.

The computer system may for instance include at least one processing unit, associated memory and a number of input/output (I/O) devices. When executing the computer program, the computer system processes information according to the computer program and produces resultant output information via I/O devices.

The connections as discussed herein may be any type of connection suitable to transfer signals from or to the respective nodes, units or devices, for example via intermediate devices. Accordingly, unless implied or stated otherwise, the connections may for example be direct connections or indirect connections. The connections may be illustrated or described in reference to being a single connection, a plurality of connections, unidirectional connections, or bidirectional connections. However, different embodiments may vary the implementation of the connections. For example, separate unidirectional connections may be used rather than bidirectional connections and vice versa. Also, plurality of connections may be replaced with a single connection that transfers multiple signals serially or in a time multiplexed manner. Likewise, single connections carrying multiple signals may be separated out into various different connections carrying subsets of these signals. Therefore, many options exist for transferring signals.

Those skilled in the art will recognize that the boundaries between logic blocks are merely illustrative and that alternative embodiments may merge logic blocks or circuit elements or impose an alternate decomposition of functionality upon various logic blocks or circuit elements. Thus, it is to be understood that the architectures depicted herein are merely exemplary, and that in fact many other architectures can be implemented which achieve the same functionality.

Thus, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or inter-medial components. Likewise, any two components so associated can also be viewed as being "operably connected," or "operably coupled," to each other to achieve the desired functionality.

Furthermore, those skilled in the art will recognize that boundaries between the above described operations are merely illustrative. The multiple operations may be combined into a single operation, a single operation may be distributed in additional operations and operations may be executed at least partially overlapping in time. Moreover, alternative embodiments may include multiple instances of a particular operation, and the order of operations may be altered in various other embodiments.

Also for example, the examples, or portions thereof, may implemented as soft or code representations of physical circuitry or of logical representations convertible into physical circuitry, such as in a hardware description language of any appropriate type.

Also, the disclosure is not limited to physical devices or units implemented in nonprogrammable hardware but can also be applied in programmable devices or units able to perform the desired device functions by operating in accordance with suitable program code, such as mainframes, minicomputers, servers, workstations, personal computers, notepads, personal digital assistants, electronic games, automotive and other embedded systems, cell phones and various other wireless devices, commonly denoted in this application as computer systems.

However, other modifications, variations and alternatives are also possible. The specifications and drawings are, accordingly, to be regarded in an illustrative rather than in a restrictive sense.

What is claimed is:

1. An audio signal processing apparatus for modifying a stereo image of a stereo signal that includes first and second audio signals, the audio signal processing apparatus comprising:

a memory storing a computer program; and a processor configured to execute the computer program to cause the audio signal processing apparatus to:

obtain panning indexes and panning gains, wherein the panning indexes characterize panning locations for stereo signal time-frequency segments and the panning gains characterize panning locations for time-frequency signal segments of the first and second audio signals;

apply a mapping function to at least all panning indexes of the stereo signal time-frequency segments that are within a frequency bandwidth, thereby providing modified panning indexes;

determine modified panning gains for time-frequency signal segments of the first and second audio signals based on the modified panning indexes; and re-pan the stereo signal according to ratios between the modified panning gains and the panning gains of the first and second audio signals that correspond to the modified panning gains in time and frequency, thereby providing a re-panned stereo signal;

wherein the processor is further configured to execute the computer program to cause the audio signal processing apparatus to:

determine the at least all panning indexes based on comparing time-frequency signal segment values of the first and second audio signals that correspond in time and frequency; and determine the panning gains for the time-frequency signal segments of the first and second audio signals based on the at least all panning indexes.

2. The audio signal processing apparatus of claim 1, wherein applying the mapping function comprises applying a non-linear mapping function to the at least all panning indexes.

3. The audio signal processing apparatus claim 1, wherein the mapping function is based on a sigmoid function.

4. The audio signal processing apparatus of claim 3, wherein the mapping function is expressed as or based on:

$$\Psi'(m,k) = \text{sign}(\Psi(m,k))\frac{\frac{1}{1+e^{-|\Psi(m,k)|a}} - 0.5}{\frac{1}{1+e^{-a}} - 0.5},$$

wherein $\Psi(m,k)$ denotes a panning index, $\Psi'(m,k)$ denotes a modified panning index, and a controls a mapping function curvature.

5. The audio signal processing apparatus of claim 1, wherein applying the mapping function comprises applying a polynomial mapping function to the at least all panning indexes.

6. The audio signal processing apparatus of claim 1, wherein re-panning the stereo signal comprises re-panning the stereo signal according to the following equations:

$$X_1'(m,k) = \frac{g_L'(m,k)}{g_L(m,k)}X_1(m,k),$$

$$X_2'(m,k) = \frac{g_R'(m,k)}{g_R(m,k)}X_2(m,k),$$

wherein:

$X_1(m,k)$ denotes a time-frequency signal segment of the first audio signal, $X_2(m,k)$ denotes a time-frequency signal segment of the second audio signal, $X_1'(m,k)$ denotes a time-frequency signal segment of a re-panned first audio signal of the re-panned stereo signal, $X_2'(m,k)$ denotes a time-frequency signal segment of a re-panned second audio signal of the re-panned stereo signal, $g_L(m,k)$ denotes a time-frequency signal segment panning gain for the first audio signal, $g_R(m,k)$ denotes a time-frequency signal segment panning gain for the second audio signal, $g'_L(m,k)$ denotes a time-frequency signal segment modified panning gain for the first audio signal, and $g'_R(m,k)$ denotes a time-frequency signal segment modified panning gain for the second audio signal.

7. The audio signal processing apparatus of claim 1, wherein determining the modified panning gains for the time-frequency signal segments of the first and second audio signals comprises determining the modified panning gains based on the following equations:

$$g_L'(m,k) = \cos\left(\frac{\pi}{2}\Psi'(m,k)\right),$$

$$g_R'(m,k) = \sin\left(\frac{\pi}{2}\Psi'(m,k)\right).$$

8. The audio signal processing apparatus of claim 1, wherein applying the mapping function comprises applying the mapping function to all panning indexes of stereo signal time-frequency segments having values for audio signals that are approximately at least 1500 Hz.

9. The audio signal processing apparatus of claim 1, wherein applying the mapping function comprises applying the mapping function to all panning indexes of the stereo signal time-frequency segments.

10. The audio signal processing apparatus of claim 1, wherein the processor is further configured to execute the computer program to cause the audio signal processing apparatus to:

receive a parameter for selecting a curve of the mapping function.

11. The audio signal processing apparatus of claim 1, wherein determining the at least all panning indexes based on comparing the time-frequency signal segment values and/or determining the panning gains for the time-frequency signal segments is based on a polynomial function.

12. The audio signal processing apparatus of claim 1, wherein the processor is further configured to execute the computer program to cause the audio signal processing apparatus to perform at least one of:

transforming the stereo signal from the time domain to the frequency domain; and transforming the re-panned stereo signal from the frequency domain to the time domain.

13. The audio signal processing apparatus of claim 1, wherein the processor is further configured to execute the computer program to cause the audio signal processing to:

cancel cross-talk between a first and a second audio signal of the re-panned stereo signal.

14. An audio signal processing method for modifying a stereo image of a stereo signal that includes first and second audio signals, the audio signal processing method comprising:

obtaining panning indexes and panning gains, wherein the panning indexes characterize panning locations for stereo signal time-frequency segments and the panning gains characterize panning locations for time-frequency signal segments of the first and second audio signals;

applying a mapping function to at least all of the panning indexes of the stereo signal time-frequency segments that are within a frequency bandwidth, thereby providing modified panning indexes;

determining modified panning gains for the time-frequency signal segments of the first and second audio signals based on the modified panning indexes; and repanning the stereo signal according to ratios between the modified panning gains and the panning gains that correspond to the modified panning gains in time and frequency;

wherein the audio signal processing method further comprises:

determining the at least all panning indexes based on comparing time-frequency signal segment values of the first and second audio signals that correspond in time and frequency; and determining the panning gains for the time-frequency signal segments of the first and second audio signals based on the at least all panning indexes.

15. The method of claim 14, wherein applying the mapping function comprises applying a non-linear mapping function to the at least all panning indexes.

16. The method of claim 14, wherein the mapping function is based on a sigmoid function.

17. The method of claim 16, wherein the mapping function is expressed as or based on:

$$\Psi'(m,k) = \text{sign}(\Psi(m,k))\frac{\frac{1}{1+e^{-|\Psi(m,k)|a}} - 0.5}{\frac{1}{1+e^{-a}} - 0.5},$$

wherein $\Psi(m,k)$ denotes a panning index, $\Psi'(m,k)$ denotes a modified panning index, and a controls a mapping function curvature.

18. The method of claim 14, wherein re-panning the stereo signal comprises re-panning the stereo signal according to the following equations:

$$X_1'(m,k) = \frac{g_L'(m,k)}{g_L(m,k)} X_1(m,k),$$

$$X_2'(m,k) = \frac{g_R'(m,k)}{g_R(m,k)} X_2(m,k),$$

wherein:

$X_1(m,k)$ denotes a time-frequency signal segment of the first audio signal, $X_2(m,k)$ denotes a time-frequency signal segment of the second audio signal, $X_1'(m,k)$ denotes a time-frequency signal segment of a re-panned first audio signal of the re-panned stereo signal, $X_2'(m,k)$ denotes a time-frequency signal segment of a re-panned second audio signal of the re-panned stereo signal, $g_L(m,k)$ denotes a time-frequency signal segment panning gain for the first audio signal, $g_R(m,k)$ denotes a time-frequency signal segment panning gain for the second audio signal, $g'_L(m,k)$ denotes a time-frequency signal segment modified panning gain for the first audio signal, and $g'_R(m,k)$ denotes a time-frequency signal segment modified panning gain for the second audio signal.

19. The method of claim 14, wherein determining the modified panning gains for time-frequency signal segments of the first and second audio signals comprises determining the modified panning gains based on the following equations:

$$g_L'(m,k) = \cos\left(\frac{\pi}{2}\Psi'(m,k)\right),$$

$$g_R'(m,k) = \sin\left(\frac{\pi}{2}\Psi'(m,k)\right).$$

* * * * *